US009995106B2

(12) United States Patent
Razvi et al.

(10) Patent No.: US 9,995,106 B2
(45) Date of Patent: Jun. 12, 2018

(54) HYDRAULICALLY RELEASED RUNNING TOOL FOR SETTING A WHIPSTOCK ANCHOR BEFORE CEMENTING THERETHROUGH

(71) Applicant: BAKER HUGHES INCORPORATED, Houston, TX (US)

(72) Inventors: Athar M. Razvi, Spring, TX (US); Cristian A. Esparza, Houston, TX (US)

(73) Assignee: Baker Hughes, a GE company, LLC, Houston, TX (US)

( * ) Notice: Subject to any disclaimer, the term of this patent is extended or adjusted under 35 U.S.C. 154(b) by 254 days.

(21) Appl. No.: 14/881,540

(22) Filed: Oct. 13, 2015

(65) Prior Publication Data

US 2017/0101838 A1 Apr. 13, 2017

(51) Int. Cl.
*E21B 23/01* (2006.01)
*E21B 33/13* (2006.01)
*E21B 7/06* (2006.01)

(52) U.S. Cl.
CPC ..... *E21B 33/13* (2013.01); *E21B 7/061* (2013.01); *E21B 23/01* (2013.01)

(58) Field of Classification Search
CPC ..... E21B 33/13; E21B 7/061; E21B 23/01
USPC ..... 166/377
See application file for complete search history.

(56) References Cited

U.S. PATENT DOCUMENTS

| | | | | |
|---|---|---|---|---|
| 5,549,163 | A | 8/1996 | Sieber | |
| 5,909,770 | A | 6/1999 | Davis | |
| 6,554,062 | B1 * | 4/2003 | Dewey | E21B 7/061 166/117.6 |
| 7,373,984 | B2 | 5/2008 | Pratt et al. | |
| 8,490,697 | B2 | 7/2013 | Garcia et al. | |
| 2013/0168151 | A1 * | 7/2013 | Grigor | E21B 23/04 175/61 |
| 2014/0338908 | A1 * | 11/2014 | Ervin | E21B 33/13 166/285 |

* cited by examiner

*Primary Examiner* — Taras P Bemko
(74) *Attorney, Agent, or Firm* — Steve Rosenblatt

(57) ABSTRACT

A running tool for a subterranean tool releases hydraulically. When used with a whipstock and anchor, the running tool can be dovetailed to the whipstock ramp to allow transmission of torque and downward force on the whipstock when positioning. An upward force can be transmitted to the whipstock from collet that is supported by a ball seat. The anchor is set and a passage opened through the anchor before cementing. The running tool is then released and a passage is opened for cementing. Release of the running tool results from shifting the ball seat that supports the collet. Cement can then bypass the seated ball and back through the ports in the ball seat. Removal of the running tool is assured by applying an upward force without needing rotation or other string manipulation that can be difficult in a deviated borehole.

19 Claims, 3 Drawing Sheets

HYDRAULICALLY RELEASED RUNNING TOOL FOR SETTING A WHIPSTOCK ANCHOR BEFORE CEMENTING THERETHROUGH

FIELD OF THE INVENTION

The field of the invention is running tools for whipstocks and more particularly where the running tool releases from the whipstock with tubing pressure after setting an anchor for the whipstock and before pumping cement through the anchor.

BACKGROUND OF THE INVENTION

Whipstocks are essentially long ramps that direct a milling assembly laterally into a tubular wall to form an opening referred to as a window for a lateral exit from a main bore or an existing lateral to a main bore. These whipstocks have to be properly oriented so that the mill will exit in a desired orientation into the producing or injection zone, depending on the application. Measurement while drilling or wireline gyro tools assist in the orientation of the whipstock ramp before an underlying anchor is set for fixation of the whipstock.

FIG. 1 illustrates a currently available design of a mechanically supported whipstock and anchor where the running tool engages a whipstock opening. Typically, the running tool 10 has a hook 12 that engages an opening 14 in the whipstock ramp 16. A shear pin or bolt 18 initially secures the running tool 10 to the top of the ramp 16 when running in. Running tool 10 has an extension tube 20 that runs through the whipstock body under the ramp 16 and into a seal bore 22 of a bottom sub 24 connected below the ramp 16. An anchor A is located below bottom sub 24. The procedure with this design is to cement through the anchor onto a support that exists in the borehole that is not shown to create a barrier that is requested by some operators. When cementing to create a barrier is concluded, a ball is dropped on a seat near the anchor A to set the anchor. The running tool is then released by shearing pin or bolt 18 by setting down weight against the set anchor to get the hook 12 out of opening 14 in ramp 16 followed by rotating before pulling out of the hole with the running tool 10 so as to avoid re-engaging the hook 12 in the opening 14 on the way out of the hole.

There are several limitations in this process. One is that the running tool 10 may be positioned in a highly deviated portion of a borehole making rotation difficult and further reducing surface feedback as to how much rotation has actually taken place at the hook 12 with a given amount of rotation at the surface. In a deviated borehole, rubbing on the wall can result in far less rotation at a downhole end of a string than the rotation applied at the surface. The other issue is that since the attempt to release the running tool 10 happens after cementing, there are concerns that the extension tube 20 may not come out of the anchor A. Another concern may be that in trying to set the anchor with a ball landed on a seat after cementing there may be an issue of getting a good enough seal on the ball to the seat to set the anchor A as there may be residual cement on the seat from the cementing step that preceded setting the anchor.

Generally relevant to the setting or retrieving of whipstocks and the use of running tools for whipstocks are: U.S. Pat. No. 5,909,770; U.S. Pat. No. 7,373,984; U.S. Pat. No. 8,490,697 and U.S. Pat. No. 5,549,163.

The present invention makes it possible to release the running tool before cementing. The running tool is released hydraulically rather than mechanically so rotation for release is not needed. The running tool is dovetailed to the whipstock ramp so that downward force and torque can be transmitted to the whipstock from the running tool without concern of the two becoming disengaged. The placement of the running tool components in position for cementing accomplishes the running tool release before the cement is pumped. The running tool can initially deliver uphole force to the whipstock when being positioned or when running in. In a more specific example the shifting of a ball seat in the running tool removes support for a collet that connect the running tool to the whipstock while at the same time opening a cement passage around a seated ball and through the ball seat to deliver cement through the already set anchor that has had a passage through it opened up as the anchor was set. The above are some aspects of the present invention but those skilled in the art will appreciate additional features from a review of the detailed description of the preferred embodiment and the associated drawings while recognizing that the full scope of the invention is to be determined from the appended claims.

SUMMARY OF THE INVENTION

A running tool for a subterranean tool releases hydraulically. When used with a whipstock and anchor the running tool can be dovetailed to the whipstock ramp to allow transmission of torque and downward force on the whipstock when positioning. An upward force can be transmitted to the whipstock from the collet that is supported by a ball seat. The anchor is set and a passage opened through the anchor before cementing. The running tool is then released and a passage is opened for cementing. Release of the running tool results from shifting the ball seat that supports the collet. Cement can then bypass the seated ball and back through the ports in the ball seat. The unsupported collet no longer retains the running tool to the whipstock. Removal of the running tool is assured by applying an upward force without needing rotation or other string manipulation that can be difficult in a deviated borehole. With the running tool released before cementing, release is more certain.

DETAILED DESCRIPTION OF THE PREFERRED EMBODIMENT

Figure 1:
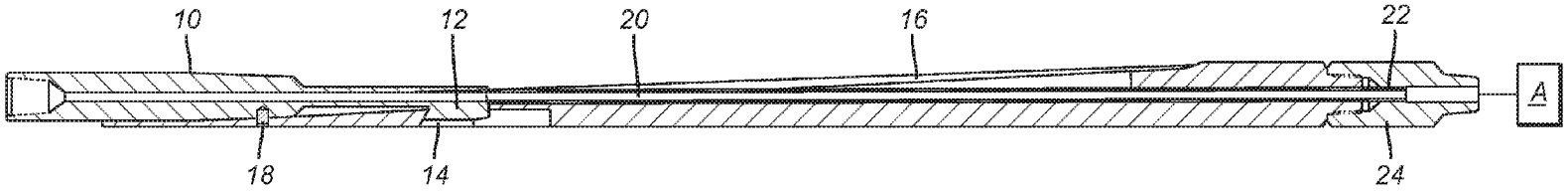
(PRIOR ART) FIG. 1
FIG. 1 is a prior art assembly view of a whipstock supported by a mechanically released running tool of a known design.
Figure 2A:
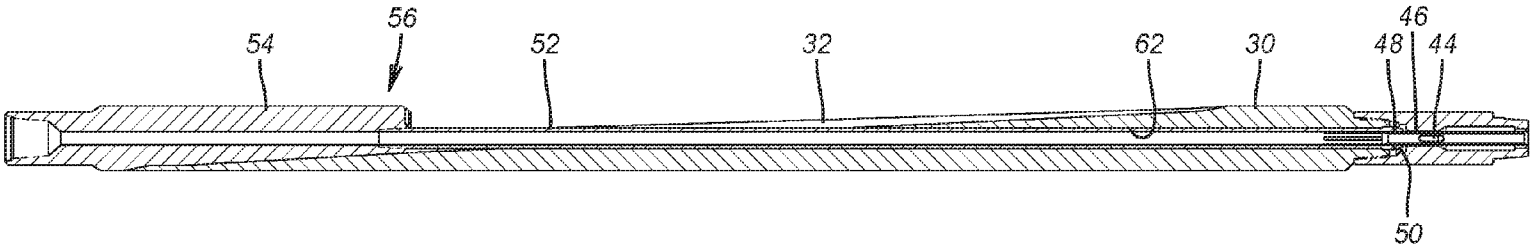
FIGS. 2*a* and 2*b* show a section view through the whipstock assembly and a schematically represented anchor associated with the whipstock in the running in position.
Figure 2B:
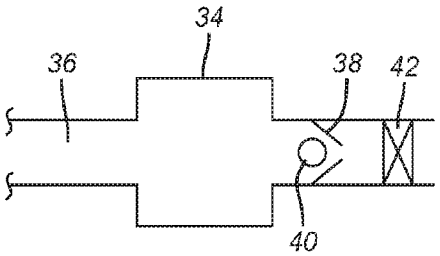

FIGS. 2*a* and 2*b* reflect a run in position of the whipstock 30 that has a ramp 32 and an anchor 34 that has a passage 36 in which can be found a ball seat 38 on which lands a first ball 40 for pressuring up and setting the anchor 34. A rupture disc 42 can be optionally used instead of the seat 38 that accepts a ball 40. After the anchor 34 is set, the first ball 40 with seat 38 can be blown out to reopen passage 36 for eventual pumping of cement or other material.

What enables the anchor 34 to be set first is that there is no ball on ball seat 46 when applying pressure to set anchor 34. The position of the ball seat 46 is held for run in by a shear pin(s) or screw(s) or other breakable member 48 that holds the ball seat 46 to the collet tabs 50 that are at the lower end of the extension tube 52. Extension tube 52 goes through the body of the whipstock 30 from a top sub 54 of the running tool assembly 56. The collet tabs 50 have an uphole facing shoulder 58 that registers with a facing shoulder 60 on the whipstock 30 so that the weight of the whipstock 30 and the anchor 34 can be supported by the running tool assembly 56. This happens because shoulder 58 on collet tabs 50 is supported radially during running in by the ball seat 46 within the collet tabs 50.

The method of setting uses ball 40 as the first ball to set the anchor 34 or alternatively pressure is applied to the rupture disc 42 to set the anchor 34 followed by opening passage 36 in the anchor 34 after setting the anchor 34. Opening passage 36 can be by blowing out ball 40 with seat 38 or simply breaking a rupture disc 42 after the anchor 34 is set. Thereafter, a bigger ball 64 than ball 40 is landed on seat 66 and pressure is applied to shift the ball seat 46 with ball 64 in a downhole direction to allow the ports 44 to open as those ports enter an enlarged dimension 68 and as a result cement or other material delivered into tube 52 can bypass seated ball 64 to flow through ball seat 46 via now open ports 44 and through the open passage 36 in the set anchor 34.

Figure 3A:
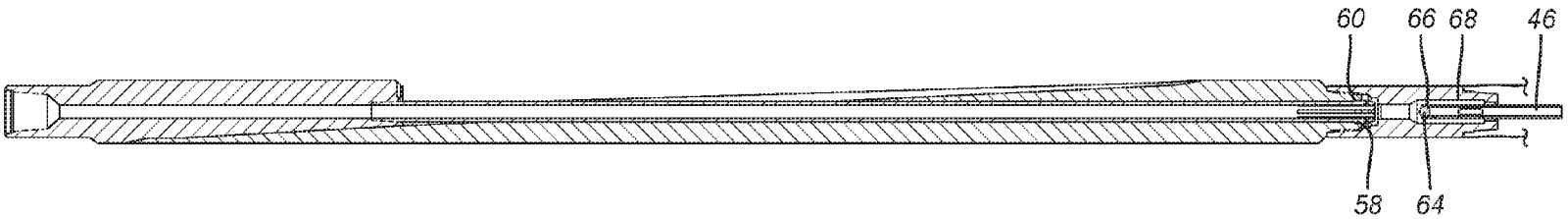
FIGS. 3*a* and 3*b* show the view of FIGS. 2*a* and 2*b* after the anchor is set with the running tool released just before cementing starts.
Figure 3B:
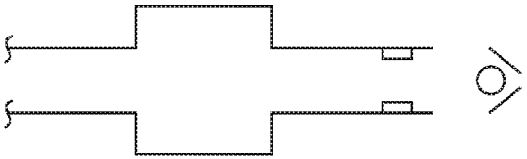

At the same time that the ball 64 and ball seat 46 are shifted, the collet tabs 50 become unsupported as the shear pin(s) or screw(s) or breakable member 48 is broken to allow the downhole direction movement of the ball 64 with the ball seat 46. Shoulders 58 can flex inwardly to clear shoulders 60 on the whipstock 30 so that the running tool assembly 56 is in released position before any cementing starts. In the released position, FIG. 3*a*, it is the set anchor 34 shown with an open passage 36 in FIG. 3*b* that now is supporting the whipstock 30 before cement is delivered.

When the cement plug, not shown, is created by passing cement through the now open passage 36 in set anchor 34 the running tool assembly 56 can come straight out of the hole with tube 52 and collet tabs 50. No rotation is required for release or removal of the running tool assembly 56.

Figure 4:
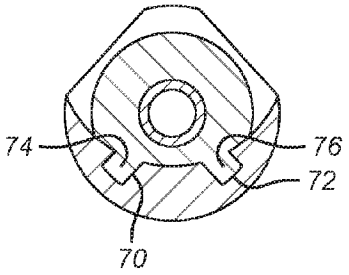
FIG. 4 is a section view through line 4-4 of FIG. 5 to show the dovetail connection of the running tool to the whipstock.
Figure 5:
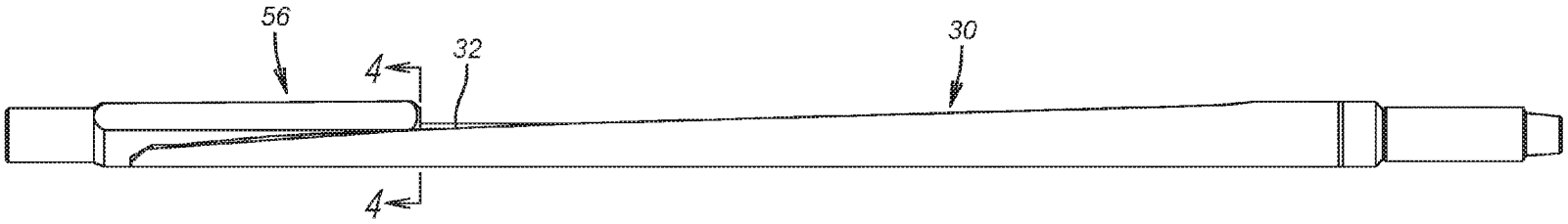
FIG. 5 is a layout of the whipstock with the running tool shown connected for transmission of torque and downhole oriented force to the whipstock.

FIGS. 4 and 5 illustrate how the running tool assembly 56 is secured to the ramp 32 of whipstock 30 for transmission of torque and downhole directed force. As seen in FIG. 4 the ramp 32 has spaced dovetail grooves 70 and 72 which have a predetermined length. Lugs 74 and 76 slide into an open end of dovetail grooves 70 and 72 on ramp 32 and before the pin or pins 48 are secured to the collet tabs 50 and the ball seat 46. Lugs 74 and 76 having the shape of dovetail slots 70 and 72 hold the running tool assembly 56 firmly to the ramp 32 so that they do not come apart and so that torque or downward force can be transmitted from running tool assembly 56 through lugs 74 and 76 into the whipstock 30 as the lugs are against bottoms of slots 70 and 72 on ramp 32. These relationships facilitate manipulation of the whipstock 30 before it is anchored with setting of anchor 34.

Those skilled in the art will appreciate that the assembly that is described can allow an anchor to be set and a passage through it opened before cement or another material is delivered. The running tool is also released from the whipstock before the cement is delivered. The release of the running tool occurs hydraulically and needs no rotation. The mounting of the running tool to the whipstock allows them to stay together during torque transmission or when force is applied in a downhole direction. The dovetail mounting relationship allows the running tool and the whipstock to maintain their relative position during running in but also promotes coming apart during relative axial movement of the running tool with the whipstock anchored by the anchor. The opening up of a cement passage around a seated ball on a ball seat is the same movement that releases the running tool collet tabs from their supporting grip on the lower end of the whipstock. If cementing below the anchor is not needed then the anchor is simply set with tubing pressure and no passage through needs to be opened. The subsequent seating of a ball to move a ball seat will release the running tool from the whipstock in the manner described above. Being able to release from the whipstock prior to cementing facilitates removal of the running tool as opposed to trying to release the running tool after cementing.

The above description is illustrative of the preferred embodiment and many modifications may be made by those skilled in the art without departing from the invention whose scope is to be determined from the literal and equivalent scope of the claims below:

We claim:

1. A whipstock and anchor combination for subterranean use, comprising:

a running tool releasably supporting a whipstock and anchor;

said running tool in selective fluid pressure communication with said anchor and through said whipstock for setting said anchor;

a pressure activated release actuated through said running tool to release said running tool from said whipstock after said anchor is set said pressure activated release comprises a temporary obstruction in a passage in said running tool that is reopened though a bypass around said obstruction after said running tool is released from said whipstock to allow flow communication through said released running tool, said bypass and through a lower end of said anchor.

2. The combination of claim 1, wherein:

said anchor further comprises a flow passage therethrough that is opened when or after setting said anchor.

3. The combination of claim 2, wherein:

said running tool comprises a flow passage extending to said anchor, whereupon setting said anchor said flow passage communicates with said opened flow path to allow delivery of material through said whipstock and anchor through said flow passage and said flow path with said setting tool already released from said whipstock.

4. The combination of claim 1, wherein:

said anchor is set with an object landed on a seat in said anchor or a breakable member in a flow path through said anchor.

5. The combination of claim 4, wherein:

said flow path is opened when or after said anchor is set.

6. The combination of claim 1, wherein:

said running tool is engaged to at least one groove in said whipstock.

7. The combination of claim 6, wherein:

said groove is engaged by at least one lug on said running tool in a dovetail relation to hold said running tool and whipstock together.

8. The combination of claim 7, wherein:

said at least one groove comprises spaced grooves and said at least one lug comprises spaced lugs to engage said spaced grooves for transmission of torque and for setting down weight from said running tool onto said whipstock;

said lugs pulling out of said grooves when said running tool is released and pulled away from said whipstock.

9. A whipstock and anchor combination for subterranean use, comprising:

a running tool releasably supporting a whipstock and anchor;

said running tool in selective fluid pressure communication with said anchor and through said whipstock for setting said anchor;

a pressure activated release actuated through said running tool to release said running tool from said whipstock after said anchor is set;

said pressure activated release comprises a temporary obstruction in a passage in said running tool that is reopened after said running tool is released from said whipstock to allow flow communication to said anchor;

said temporary obstruction comprises a ported sleeve comprising a seat, wherein ports in said ported sleeve are closed until an object lands on said seat and said object and sleeve move in tandem in response to pressure applied to said object to reopen said ports for flow access to said anchor.

10. A whipstock and anchor combination for subterranean use, comprising:

a running tool releasably supporting a whipstock and anchor;

said running tool in selective fluid pressure communication with said anchor and through said whipstock for setting said anchor;

a pressure activated release actuated through said running tool to release said running tool from said whipstock after said anchor is set;

said anchor further comprises a flow path that opens when or after the anchor is set;

said pressure activated release comprises a ported sleeve with ports initially closed to conduct pressure from said running tool and through said whipstock to said anchor for opening said flow path while or after setting said anchor;

said ported sleeve is shifted with pressure on an object landed on a seat on said ported sleeve to open said ports which reopens flow communication from said running tool through said ported sleeve to said flow path while at the same time releasing said running tool from said whipstock.

11. The combination of claim 10, wherein:

said ported sleeve with said ports initially closed supports a lock that allows said running tool to support said whipstock;

shifting said ported sleeve undermines said lock to release said running tool from said whipstock.

12. The combination of claim 11, wherein:

said lock further comprises at least one collet positioned to support said whipstock when said ported sleeve is located within said collets to hold them to a support surface on said whipstock.

13. A setting method for a whipstock and anchor combination at a subterranean location, comprising:

running in a whipstock and anchor with a running tool;

setting said anchor;

opening a flow path through said anchor after said setting;

releasing said running tool from said whipstock after said opening said flow path with an object that shifts a seat to open a bypass around the object on said shifted seat;

pumping a sealing material through said running tool, whipstock and flow path through said bypass in said anchor after said releasing;

removing said running tool after said pumping.

14. The method of claim 13, comprising:

performing said releasing and removing without rotation.

15. The method of claim 13, comprising:

performing said releasing by moving a sleeve comprising said seat with pressure to unsupport at least one collet engaged to said whipstock.

16. The method of claim 13, comprising:

connecting said running tool to said whipstock with at least one lug sliding into a respective groove;

dovetailing said at least one lug with a respective groove for said lug in a dovetail relationship.

17. The method of claim 16, comprising:

transmitting torque or set down force from said running tool to said whipstock through said lug in said respective groove for said lug.

18. The method of claim 17, comprising:

sliding said lug out from said groove when separating said running tool from said whipstock.

19. A setting method for a whipstock and anchor combination at a subterranean location, comprising:

running in a whipstock and anchor with a running tool;

setting said anchor;

opening a flow path through said anchor after said setting;

releasing said running tool from said whipstock after said opening said flow path;

pumping a sealing material through said running tool, whipstock and flow path through said anchor after said releasing;

removing said running tool after said pumping;

performing said releasing by moving a sleeve with pressure to unsupport at least one collet engaged to said whipstock;

opening ports in said sleeve by said moving said sleeve to allow said pumping to enter said sleeve after going around a seated object landed on said sleeve that allowed pressure to move said sleeve.

* * * * *